US011283209B2

(12) United States Patent
Woller et al.

(10) Patent No.: US 11,283,209 B2
(45) Date of Patent: Mar. 22, 2022

(54) CONNECTOR HOUSING FOR AN ELECTRICAL CONNECTOR

(71) Applicant: TE Connectivity Germany GmbH, Bensheim (DE)

(72) Inventors: Josef Woller, Griesheim (DE); Carlo L'Abbate, Weinheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/785,166

(22) Filed: Feb. 7, 2020

(65) Prior Publication Data

US 2020/0176913 A1 Jun. 4, 2020

Related U.S. Application Data

(63) Continuation of application No. PCT/EP2018/071413, filed on Aug. 7, 2018.

(30) Foreign Application Priority Data

Aug. 9, 2017 (DE) ..... 102017118136.9

(51) Int. Cl.
*H01R 13/40* (2006.01)
*H01R 13/424* (2006.01)
(Continued)

(52) U.S. Cl.
CPC ..... *H01R 13/424* (2013.01); *H01R 13/436* (2013.01); *H01R 13/516* (2013.01); *H01R 43/20* (2013.01)

(58) Field of Classification Search
CPC .... H01R 13/436; H01R 13/516; H01R 13/40; H01R 13/42; H01R 13/46; H01R 13/424
(Continued)

(56) References Cited

U.S. PATENT DOCUMENTS 4,045,110 A * 8/1977 Sterken ..... H01R 13/436 439/345
4,973,268 A * 11/1990 Smith ..... H01R 13/4365 439/589
(Continued)

FOREIGN PATENT DOCUMENTS

CN 104508913 A 4/2015
DE 3526664 C2 2/1986
(Continued)

OTHER PUBLICATIONS

PCT Notification, The International Search Report and The Written Opinion of the International Searching Authority, International Application No. PCT/EP2018/071413, dated Nov. 6, 2018, 14 pages.
(Continued)

*Primary Examiner* — Harshad C Patel
(74) *Attorney, Agent, or Firm* — Barley Snyder

(57) ABSTRACT

A connector housing includes a contact housing receptacle and a contact housing disposed in the contact housing receptacle. The contact housing has a movable contact securing flap. The contact securing flap is disposed inside the contact housing receptacle and is movable between an open position, in which the electrical contact units are unlocked in the connector housing, and a locking position in which the contact units are locked in the connector housing.

20 Claims, 8 Drawing Sheets

(51) Int. Cl.
*H01R 13/436* (2006.01)
*H01R 13/516* (2006.01)
*H01R 43/20* (2006.01)

(58) Field of Classification Search
USPC ..... 439/701, 595
See application file for complete search history.

(56) References Cited

U.S. PATENT DOCUMENTS 4,984,998 A * 1/1991 Duncan ..... H01R 13/627 439/352
5,085,598 A * 2/1992 Kinoshita ..... H01R 13/436 439/595
5,145,356 A * 9/1992 Minnis ..... B60R 21/01 439/188
5,186,662 A * 2/1993 Yuasa ..... H01R 13/4368 439/595
5,240,439 A * 8/1993 Egenolf ..... H01R 13/18 439/745
5,603,642 A * 2/1997 Shinji ..... H01R 13/4367 439/752
5,695,368 A * 12/1997 Joly ..... H01R 13/432 439/748
6,024,605 A * 2/2000 Beck, Jr ..... H01R 13/424 439/595
6,116,953 A * 9/2000 Myer ..... H01R 13/4364 439/595
9,368,896 B2 6/2016 Suzuki et al.
9,647,378 B1 * 5/2017 Mingo ..... H01R 13/506
10,784,614 B2 * 9/2020 Kong ..... H01R 13/424
2004/0192119 A1 * 9/2004 Sakurai ..... H01R 13/64 439/752.5
2005/0085126 A1 * 4/2005 Sagawa ..... H01R 13/4365 439/595
2009/0247011 A1 * 10/2009 Myer ..... H01R 13/4365 439/595
2014/0017958 A1 * 1/2014 Nemoto ..... H01R 13/4223 439/682

FOREIGN PATENT DOCUMENTS

DE 29623355 U1 4/1998
DE 102004003385 A1 8/2004
EP 0867975 A2 9/1998
EP 0867975 A3 9/1999
GB 2422728 A 8/2006
GB 2518777 A 4/2015

OTHER PUBLICATIONS

First Office Action dated Jan. 21, 2021 in Chinese Patent Appln. No. 201880051819.7, and English translation thereof. 18 pp.
Communication from the EPO dated Sep. 27, 2021, in Appln. No. 18 752 478.0-1201, 5 pp.

* cited by examiner

CONNECTOR HOUSING FOR AN ELECTRICAL CONNECTOR

CROSS-REFERENCE TO RELATED APPLICATIONS

This application is a continuation of PCT International Application No. PCT/EP2018/071413, filed on Aug. 7, 2018, which claims priority under 35 U.S.C. § 119 to German Patent Application No. 102017118136.9, filed on Aug. 9, 2017.

FIELD OF THE INVENTION

The present invention relates to a connector housing and, more particularly, to a connector housing for an electrical connector.

BACKGROUND

In the electrical industry, a large number of electrical connector devices or connector units, socket and/or peg connectors, etc., —designated below as connectors or electrical connectors—are known, which transmit electrical currents, voltages, signals and/or data with a large range of currents, voltages, frequencies and/or data rates. In the low, middle or high voltage and/or current ranges, and in particular in the automotive industry, such connectors must ensure permanently, repeatedly and/or after a comparatively long service life without delay, a transmission of electrical power, signals and/or data in warm, possibly hot, polluted, humid and/or chemically aggressive environments. Due to a wide range of applications, a large number of specially configured connectors are known.

Such connectors or rather their housings can be installed on an electrical wire, a cable, a cable harness, forming a ready-made electrical cable, and/or an electrical unit or device such as for example at/in a housing, at/on a leadframe, at/on a printed circuit board etc., of an electrical, electro-optical or electronic component or such equipment, commonly referred to as a connector unit. If a connector is only located on a wire, a cable, or a cable harness, this is also referred to as a flying connector or a plug or a coupling, and if it is located on/in an electrical, electronic or electro-optical component, then this is also referred to as a built-in connector, plug, or socket. Furthermore, a connector to such a unit is often also identified as a receptacle or header.

Electrical connectors must ensure perfect transmission of electrical signals and/or electrical power, wherein connectors corresponding to one another (connectors and mating connectors) usually have fastening or locking arrangements for long-term, but usually releasable fastening or locking of the connector at/in the mating connector. Furthermore, corresponding electrical contact units or terminals, such as, for example, an actual electrical contact element and/or an actual electrical contact device must be securely received in them. Because the housings of the connectors are usually subject to a certain standardization, such as, for example, the FAKRA standard or a different standard, the most important dimensions of the housings have the same dimensions across different manufacturers.

Constant efforts are being made to improve electrical contact devices, electrical contact units, electrical connectors and/or ready-made electrical cables or cable harnesses, to form them in a more cost-effective manner and/or to produce them in a more cost-effective manner. It is therefore necessary, for example in the automotive industry, to be able to test a locking position of the contact units of a connector, for example an MCON connector, in order to timely identify a contact unit that is not positioned correctly. Furthermore, it is possibly necessary to have to remove a contact unit from the connector. This is problematic in particular in the case of comparatively narrow connectors, i.e. connectors with rows of contact units which are close together.

SUMMARY

A connector housing includes a contact housing receptacle and a contact housing disposed in the contact housing receptacle. The contact housing has a movable contact securing flap. The contact securing flap is disposed inside the contact housing receptacle and is movable between an open position, in which the electrical contact units are unlocked in the connector housing, and a locking position in which the contact units are locked in the connector housing.

BRIEF DESCRIPTION OF THE DRAWINGS

The invention will now be described by way of example with reference to the accompanying Figures, of which.

DETAILED DESCRIPTION OF THE EMBODIMENT(S)

Figure 2:
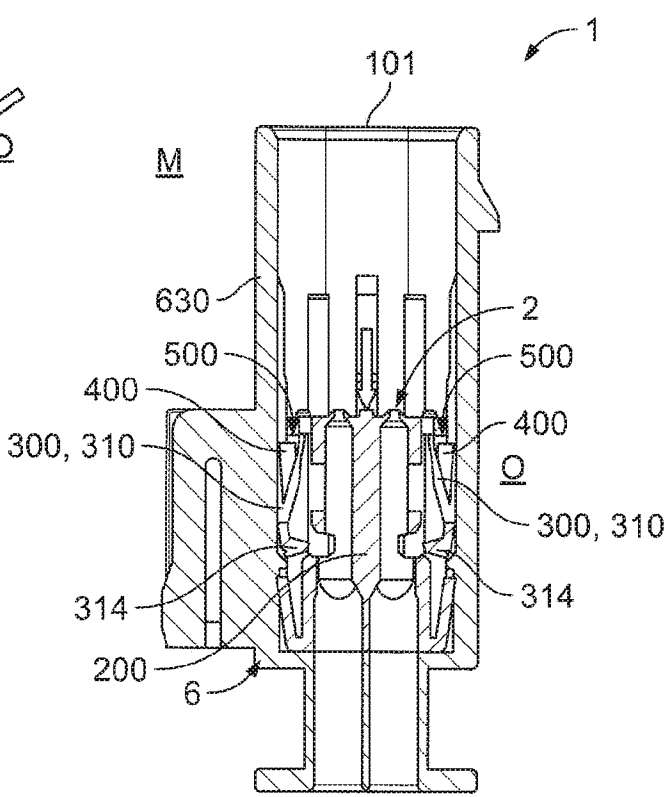
FIG. 2 is a sectional side view of the connector housing in an open position.

The invention is explained in greater detail below using exemplary embodiments with reference to the attached schematic drawings, which are not true to scale. Sections, elements, structural parts, units, diagrams and/or components which have an identical, univocal or similar design and/or function are identified by the same reference numbers. A possible alternative, a steady-state and/or kinematic reversal, a combination, etc., which is not explained in the description and which is not illustrated in the drawings and/or is inconclusive, to the exemplary embodiments of the invention or a component, a diagram, a unit, a structural part, an element or a section thereof, can be inferred from the description of the figures.

In the invention, a feature (section, element, structural part, unit, component, function, variable etc.) can be configured to be positive, i.e. present, or negative, i.e. absent, with a negative feature not being explicitly explained as a feature if the fact that it is absent is not deemed to be significant according to the invention. A feature of this specification can be applied not only in a specified manner but rather can also be applied in a different manner.

The features of this specification can also be interpreted as optional features; i.e. each feature can be understood as a non-binding feature. It is thus possible to detach a feature, optionally including its periphery, from an exemplary embodiment, with this feature then being transferable to a generalized inventive concept. The lack of a feature in an exemplary embodiment shows that the feature is optional with regard to the invention. Furthermore, in the case of a type term for a feature, a generic term for the feature can also be read alongside this, as a result of which it is possible to generalize the feature, e.g. taking into account identical effect and/or equivalence.

The invention is explained in greater detail using exemplary embodiments of an inventive connector housing 1 for an electrical connector 0, having electrical contact units 10. In various embodiments, the electrical connector 0 is a plug connector 0 or mating connector 0, in particular a flat plug 0 and/or a socket connector 0, for example an MCON connector 0, for example a ready-made electrical cable, also referred to as a cable harness, for the automotive industry. Only those spatial sections of a subject-matter of the invention which are necessary for understanding the invention are illustrated in the drawings.

Although the invention is more closely described and illustrated in more detail with reference to the exemplary embodiments, the invention is not restricted by the disclosed exemplary embodiments. Other variations can be derived herefrom without departing from the scope of protection of the invention. The electrical connector can thus also be used, for example, outside the automotive industry, for example in the computer and consumer electronics industry.

With reference to the drawings, the explanation of the invention hereinafter relates to a width direction B or a width axis B, a height direction H or a height axis H and a longitudinal direction L or a longitudinal axis L of the connector 0, of a connector housing 1, of a contact housing 2, of a contact housing receptacle 6, of the contact unit(s) 10, etc.

In an embodiment, the connector housing 1 is a housing 1 for a mounting connector 0 or a plug receptacle 0. It is of course possible to apply the invention more generally to plug connectors or mating connectors, a (flying) plug, a (flying) socket, a (flying) coupling, etc. Furthermore, in an embodiment, the connector housing 1 is formed as a housing 1 for a pin connector 0 or peg connector 0; it is of course also possible to form the connector as a socket connector, tab connector or hybrid connector.

In the connector 0, in an embodiment, one single shape and/or one single type of electrical contact units 10 is used. For example, this is an "MCON" (Multiple Contact) system. It is of course possible to combine other or different contact systems in the connector 0. For example: exclusively Nano-MQS (MQS: Micro Quadlock System, which has a square contact cross-section in a region of a mechanical and electrical contact between two electrical contact units), MCON and NanoMQS, exclusively MQS, MCON and MQS, others optionally in combination, etc.

Figure 1:
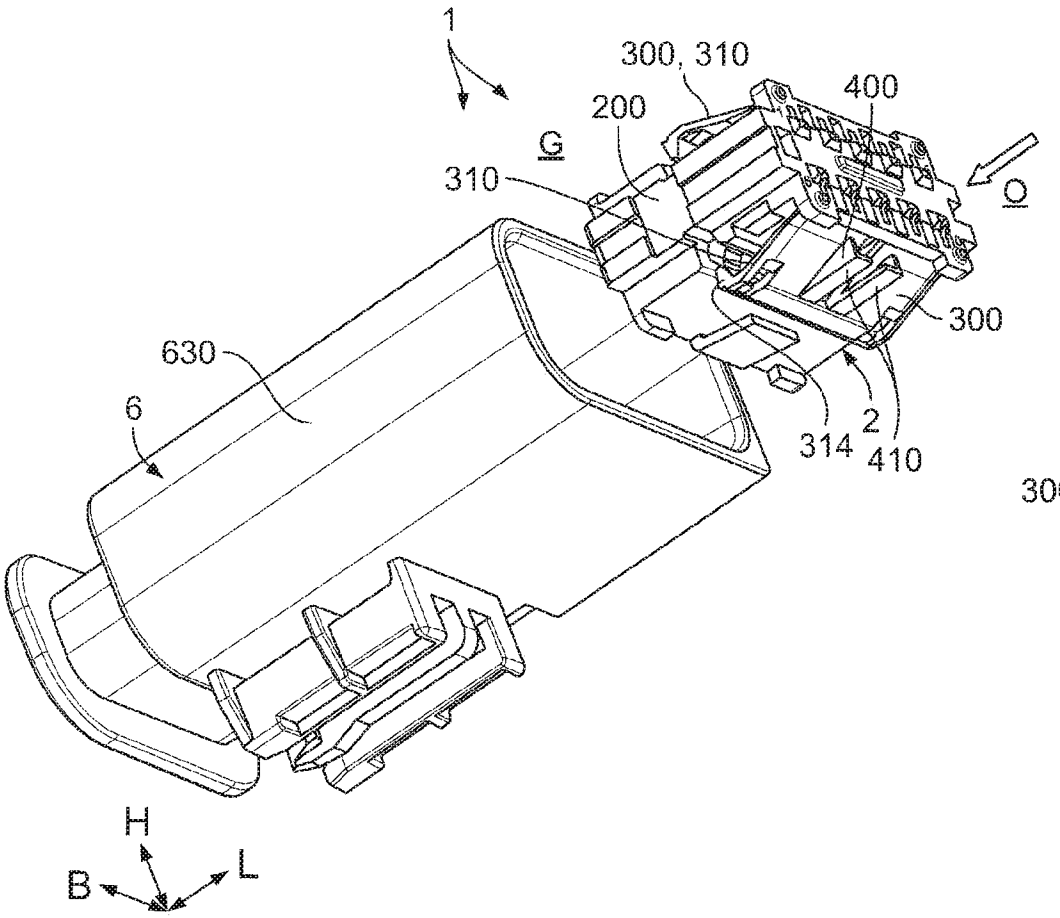
FIG. 1 is an exploded perspective view of a connector housing before assembling a contact housing in a contact housing receptacle.

The connector housing 1 according to an embodiment includes a pair of units 2, 6 separate from one another, and shown in a separated position G in FIG. 1. The pair of units 2, 6 include a contact housing receptacle 6 and a contact housing 2. The contact housing receptacle 6 and the contact housing 2 connected to one another, in particular plugged together, form the connector housing 1 which is complete and ready for use; FIGS. 2-7, 10, and 11 show an assembly position M or latching position M of the contact housing 2 at/in the contact housing receptacle 6.

In an embodiment, the contact housing 2 latches at/in contact housing receptacle 6, with the locking being effected in a releasable manner. The contact housing 2 can be fitted with the contact units 10 in at least one row, but in other embodiments in two rows. The contact housing receptacle 6 can also be identified as a surrounding housing 6, and the contact housing 2 can also be identified as an insert 2 or a contact receptacle 2.

The invention is not restricted to two such units 2, 6, but rather a plurality of units of a connector housing 1 can be mechanically coupled to one another. The connector housing 1 is formed at least in two parts, but can also be formed in three parts or multiple parts. In this case, the connector housing 1 can be formed in a single row, in two rows or in multiple rows for the contact units 10. Furthermore, the contact housing receptacle 6 can also be identified as a surrounding housing 6, and the contact housing 2 can also be identified as an insert 2 or a contact receptacle 2.

Figure 3:
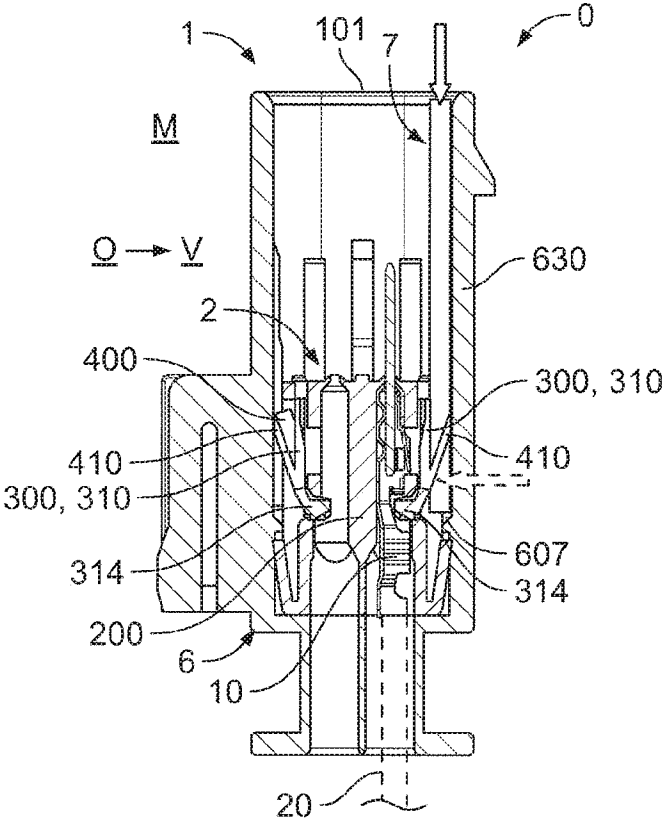
FIG. 3 is a sectional side view of the connector housing with the contact housing in a locking position.
Figure 5:
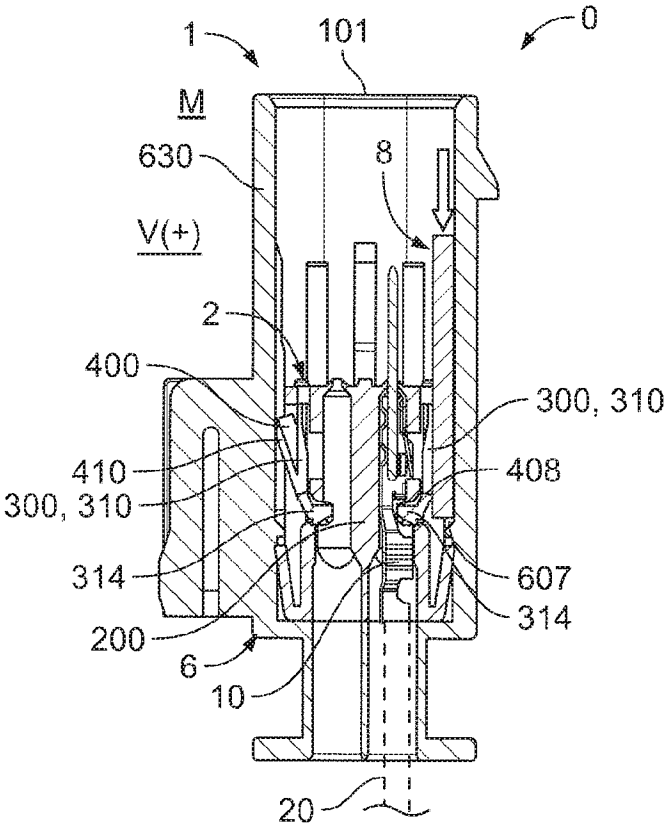
FIG. 5 is a sectional side view of the connector housing with the contact securing flap tested in a correct locking position with a testing tool.
Figure 7:
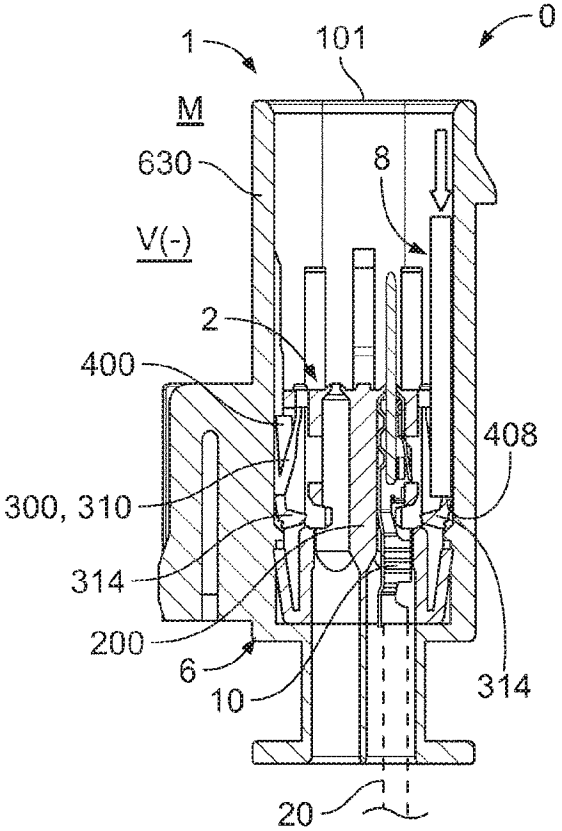
FIG. 7 is a sectional side view of the connector housing with the contact securing flap tested in an incorrect locking position with the testing tool.
Figure 10:
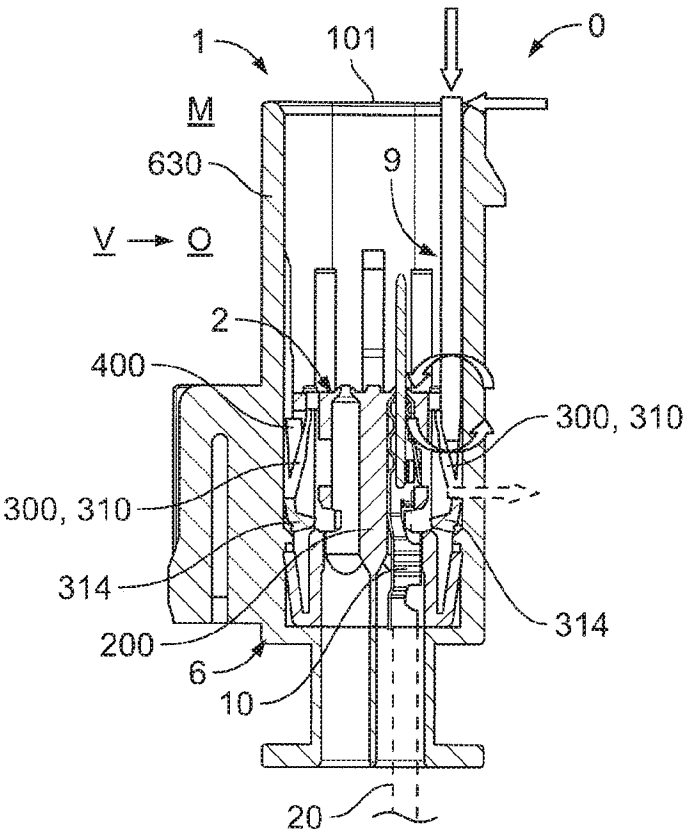
FIG. 10 is a sectional side view of the connector housing with the contact housing moved from the locking position into the open position.

The electrical connector 0, shown in FIGS. 3, 5, and 7, differs from the connector housing 1 in that it further comprises the electrical contact units 10. The connector 0 and the wires mechanically and electrically connected to the contact units 10 of the connector 0 produce an at least partially ready-made electrical cable (wire, cable harness, etc.) or at least one prefabricated cable.

The contact housing receptacle 6, as shown in FIGS. 1-7, 10, and 11, is in a first approximation a trough-shaped configuration in an embodiment of the connector housing 1 with a surrounding (outer) wall 630. The contact housing 2 can be locked or is locked inside the surrounding wall 630. Through-recesses for electrical wires 20 (cable 20, line 20, etc.) and/or electrical contact units 10 are in alignment in the contact housing receptacle 6 with recesses for the contact units 10 in the contact housing 2.

Inside the contact housing receptacle 6, a mechanical stop 607 shown in FIGS. 3-8 is provided for a locking tool 7 of the contact housing 2 and a testing tool 8 is provided for testing a correct locking position V of the contact units 10 in the connector housing 1. The mechanical stop 607 is located in the longitudinal direction L, the direction of a plug face 101 (free longitudinal end 101) of the connector 0, of the connector housing 1 or the contact housing receptacle 6. In an embodiment, the mechanical stop 607 is behind a latching device of the contact housing 2 with the contact housing receptacle 6.

The contact housing 2, shown in FIGS. 1, 8, 9, 12, 13, in an embodiment is formed in a first approximation with a square base body 200. At both sides extending in the width direction B and longitudinal direction L, the base body 200 has a contact securing flap 300, the contact securing flap 300 serving to lock the contact units 10 in the contact housing 2. The contact securing flap 300 can be considered a secondary contact securing flap 300; the contact units 10 primarily latch with locking lances, which are formed thereon, in the contact housing 2, as shown in FIGS. 3, 5, 7 and 10.

The contact securing flap 300 has a locking unit 314, in particular a latching hook 314 or a latching shoulder 314, for a locking of the contact units 10, as shown in FIGS. 1-3, 7, 8, and 13-16. For locking the contact units 10 in the contact housing 2, the contact housing 2 must be brought from the contact securing flap 300 thereof or the contact securing flap 300 from an open position O, shown in FIGS. 1, 2 and 13-16, into a locking position V, shown in FIGS. 3-6 and 8. Similar applies to an unlocking compartment 400 (see below). In the locking position V, the locking unit 314 engages through a through-recess in the base body 200, the locking unit 314 locking the contact units 10 in the contact housing 2.

Figure 6:
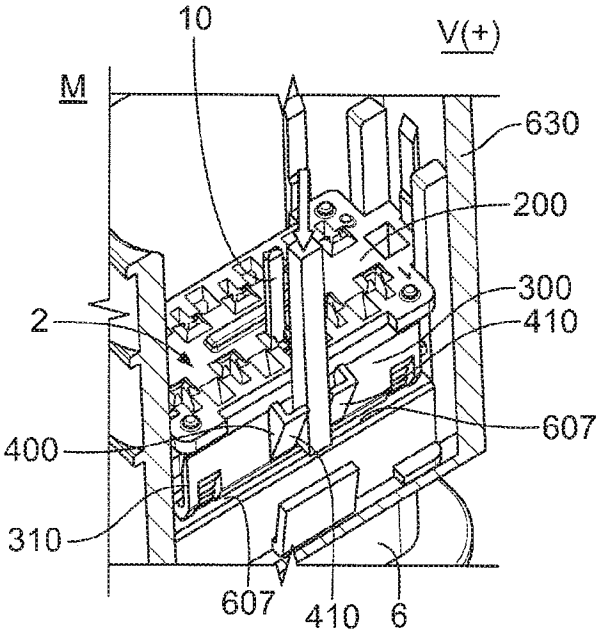
FIG. 6 is a sectional perspective view of the connector housing with the contact securing flap tested by the testing tool.

For unlocking the contact units 10 in the contact housing 2, the contact securing flap 300 must be moved from its locking position V, shown in FIGS. 5 and 6, into the open position O, shown in FIGS. 1, 2, and 10-16. Similar applies again to the unlocking compartment 400 (see below). In this case, the locking unit 314 is brought out of engagement with the contact units 10 and the locking unit 314 moves out of the through-recess in the base body 200.

The contact securing flap 300 is pivotably connected to the base body 200 in an integral manner via a material layer, for example a film hinge, of the contact housing 1, a flap wall 310 of the contact securing flap 300 extending substantially in the width direction B and longitudinal direction L. The locking unit 314 is provided at a free end of the flap wall 310. The locking unit 314, for example, protrudes therefrom at an angle of approximately 70° to 110°, and in another embodiment, of 85° to 95°. Inside the flap wall 310, a testing recess 312 can be provided into which a testing tool 8 or testing adaptor 8 for testing a correct, shown in FIGS. 6 and 8, or incorrect, shown in FIGS. 7 and 9, locking position V of the contact securing flap 300 can be introduced.

Figure 4:
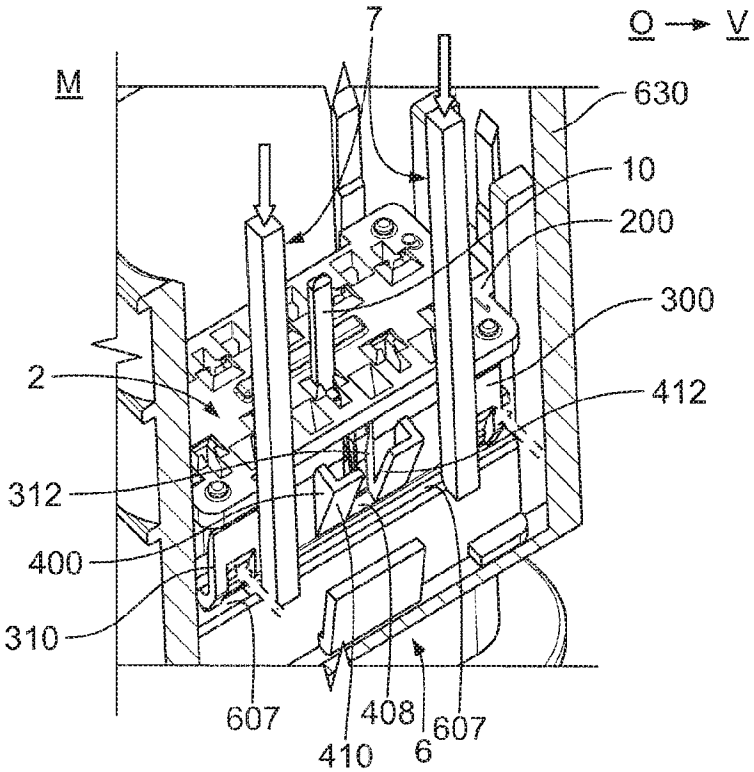
FIG. 4 is a sectional perspective view of the contact housing with a contact securing flap in the locking position.
Figure 8:
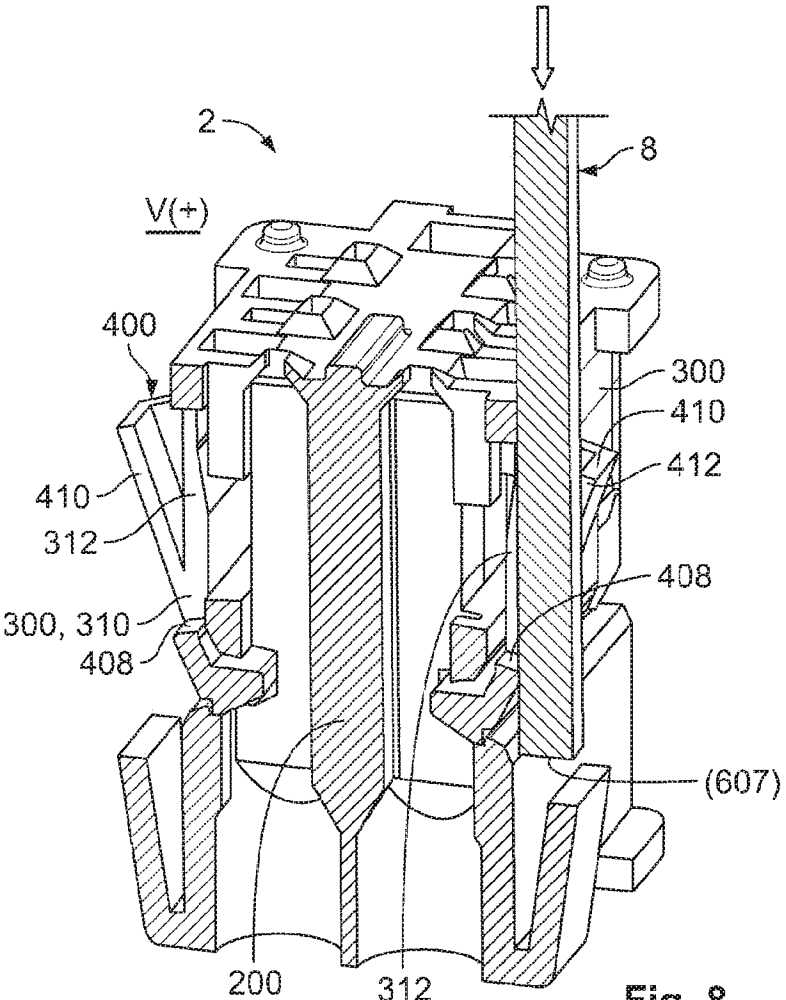
FIG. 8 is a sectional perspective view of the contact housing with the contact securing flap tested in a correct locking position by the testing tool.

As shown in FIGS. 4 and 8, the testing recess 312 is aligned in the height direction H with a testing recess 412 of an unlocking compartment 400 of the contact securing flap 300. The unlocking compartment 400 is formed from the contact securing flap 300 or protrudes therefrom. A wall of the unlocking compartment 400 which is substantially v-shaped in a cross-section in the width direction B and height direction H is formed by the flap wall 310, it being possible to provide the testing recess 312 of the flap wall 310 in this section of the flap wall 310. Cross-sectional shapes other than v-shaped can of course be used for the unlocking compartment 400.

A compartment wall 410 which is located opposite the wall of the unlocking compartment 400 in the height direction H protrudes obliquely from the flap wall 310, as shown in FIGS. 3 and 5. Laterally, i.e. in the width direction B, the unlocking compartment 400 can be closed in each case by a wall (respective connection between flap wall 310 and compartment wall 410). The testing recess 412 of the compartment wall 410 extends to the flap wall 310 in an embodiment, the flap wall 310 forming a mechanical stop 408 for the testing tool 8 in the case of an incorrect locking position, shown in FIGS. 7 and 9.

Both in the open position O and in the locking position V of the contact housing 2 or the contact securing flap 300, a slot 500 is established between the contact housing 2 and the contact housing receptacle 6 (wall 630), as shown in FIGS. 2-12. In this slot 500, the locking tool 7 for establishing the locking position V, the testing tool 8 for testing the position of the contact securing flap 300, and an unlocking tool 9 for restoring the open position O can be advanced and is optionally pivotable. Depending on whether the contact housing 2 is in its open position O or the locking position V, either the unlocking compartment 400 or a section of the contact securing flap 300 and the unlocking compartment 400 is located in the slot 500.

The contact housing 2 cooperating with the tools 7, 8, 9 or the contact housing receptacle 6 in the event of locking, testing the position of the contact securing flap 300, and unlocking the contact unit 10 will now be described in greater detail. In this case, the connector housing 1 includes the contact housing receptacle 6 in which the contact housing 2 can be established or is established, it being possible to establish and lock at least one electrical contact unit 10 in the contact housing 2 with the contact securing flap 300 of the contact housing 2.

In the open position O of the contact securing flap 300, the slot 500 is established between the contact securing flap 300 and the wall 630 of the contact housing receptacle 6, in which slot 500 the locking tool 7 for locking the contact securing flap 300 can be introduced (advanced and optionally pivoted) into the locking position V, it being possible to bring the contact securing flap 300 into engagement with the contact units 10. In this case, the locking tool 7 slides past in the width direction B away from the unlocking compartment 400 of the contact securing flap 300.

In the open position O of the contact securing flap 300, the flap wall 310 can have an orientation in which a plane of the flap wall 310 is arranged obliquely, i.e. with an angle other than 0° or 180°, relative to a longitudinal direction L of the connector housing 1. In the open position O, the compartment wall 410 of the unlocking compartment 400 away from the flap wall 310 can have an orientation in which a plane of the compartment wall 410 is arranged substantially parallel to the longitudinal direction L.

In the locking position V of the contact securing flap 300, the slot 500 is established between the contact securing flap 300 and the wall 630. The testing tool 8 for testing a correct V or incorrect locking position of the contact securing flap 300 relative to the contact units 10 can be introduced (advanced) into this slot 500. In an embodiment, the testing tool 8 is moved into the testing recess 312, 412.

In the locking position V of the contact securing flap 300, the flap wall 310 can have an orientation in which a plane of the flap wall 310 is arranged substantially parallel to the longitudinal direction L. In the locking position V, the compartment wall 410 of the unlocking compartment 400 away from the flap wall 310 can have an orientation in which a plane of the compartment wall 410 is arranged obliquely, i.e. again with an angle other than 0° or 180°, relative to the longitudinal direction L.

Figure 9:
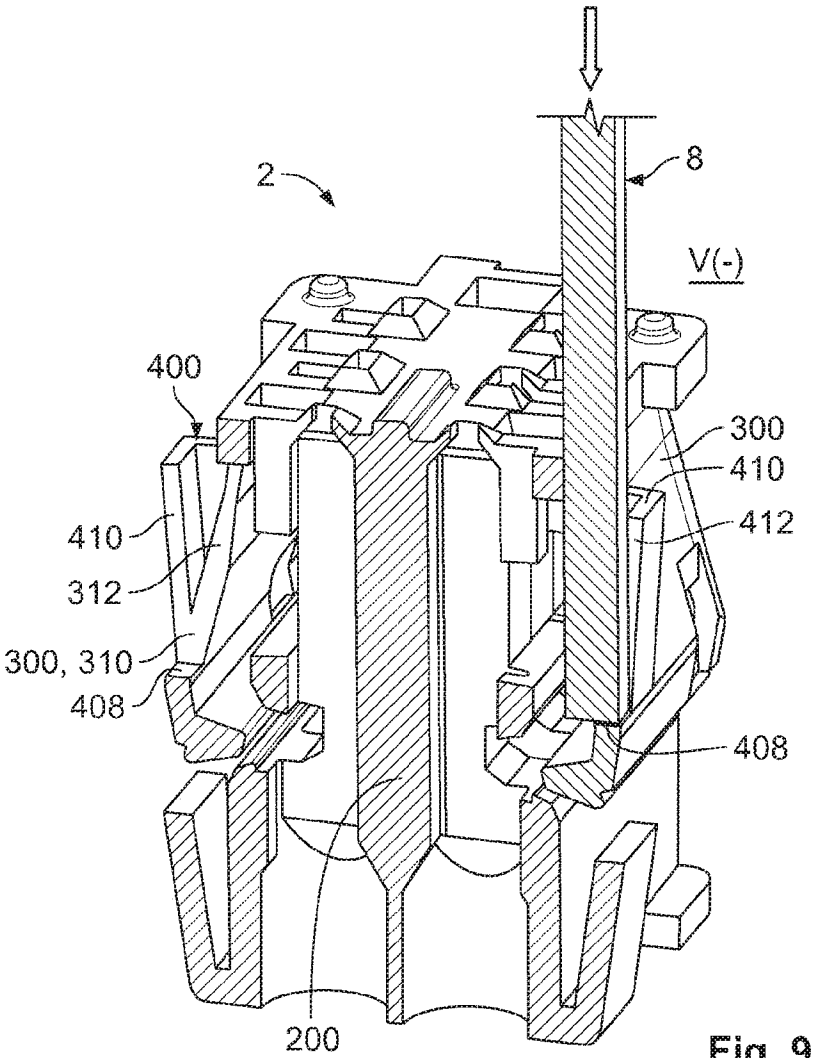
FIG. 9 is a sectional perspective view of the contact housing with the contact securing flap tested in an incorrect locking position by the testing tool.
Figure 12:
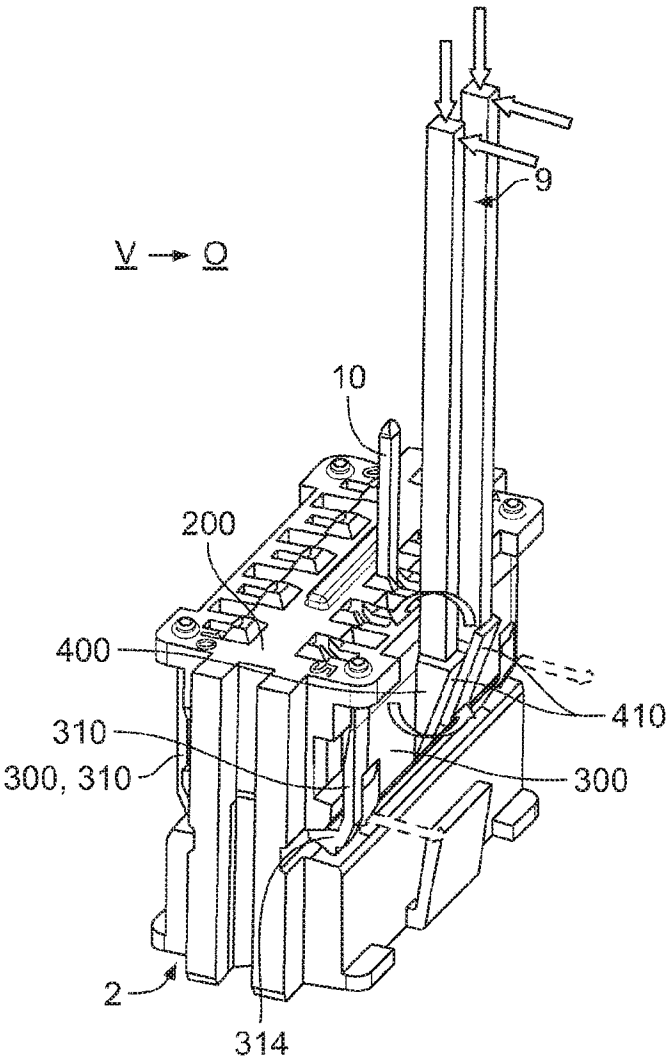
FIG. 12 is a perspective view of the contact housing with the open position established by an unlocking tool and an unlocking compartment of the contact securing flap.
Figure 11:
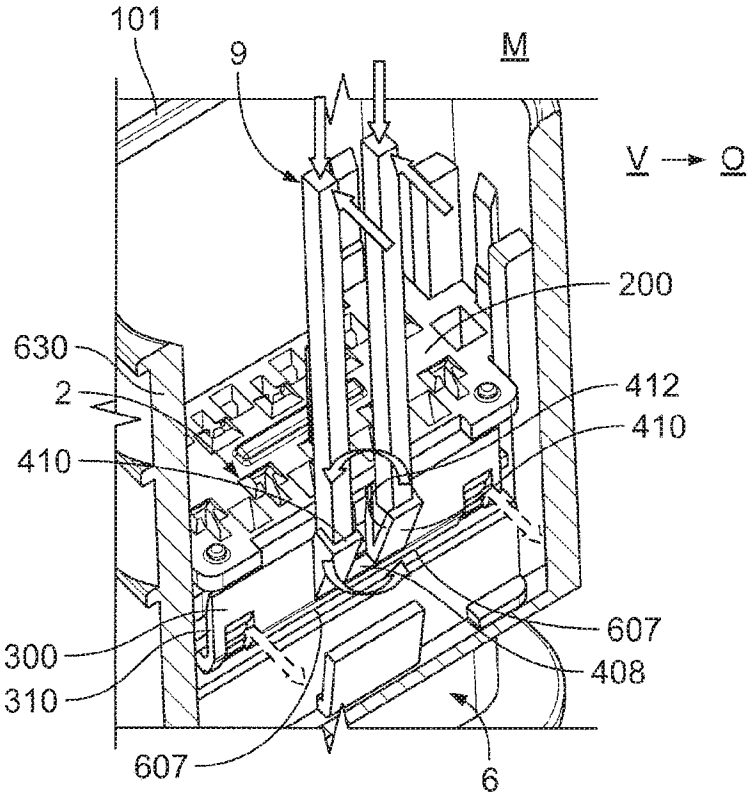
FIG. 11 is a sectional perspective view of the contact housing with the contact securing clamp moved from the locking position into the open position.
Figure 14:
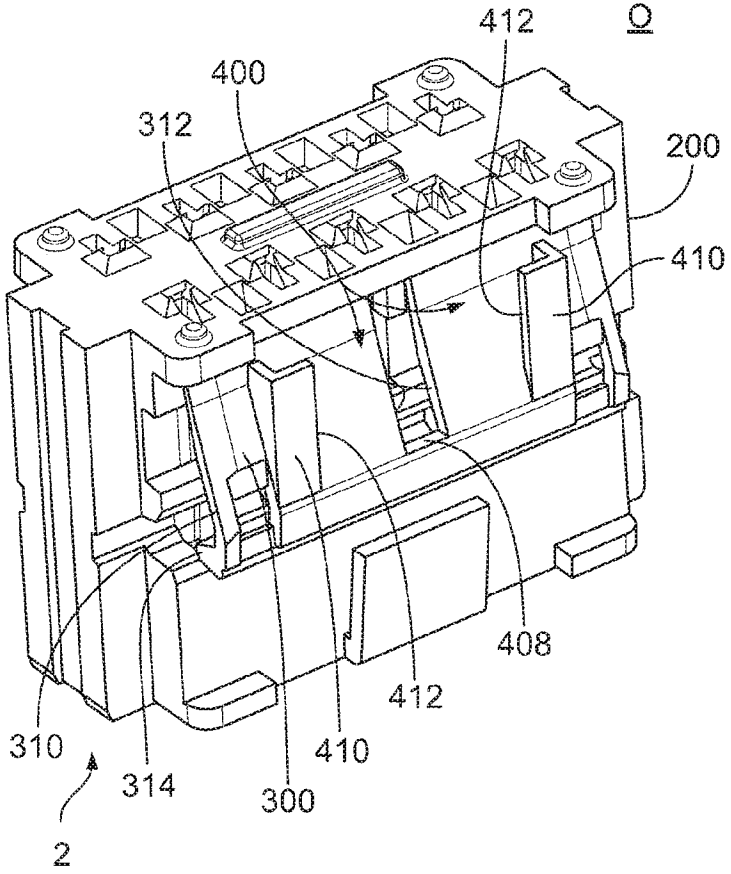
FIG. 14 is a perspective view of the contact housing with the contact securing flap in the open position with an unlocking compartment according to another embodiment.
Figure 13:
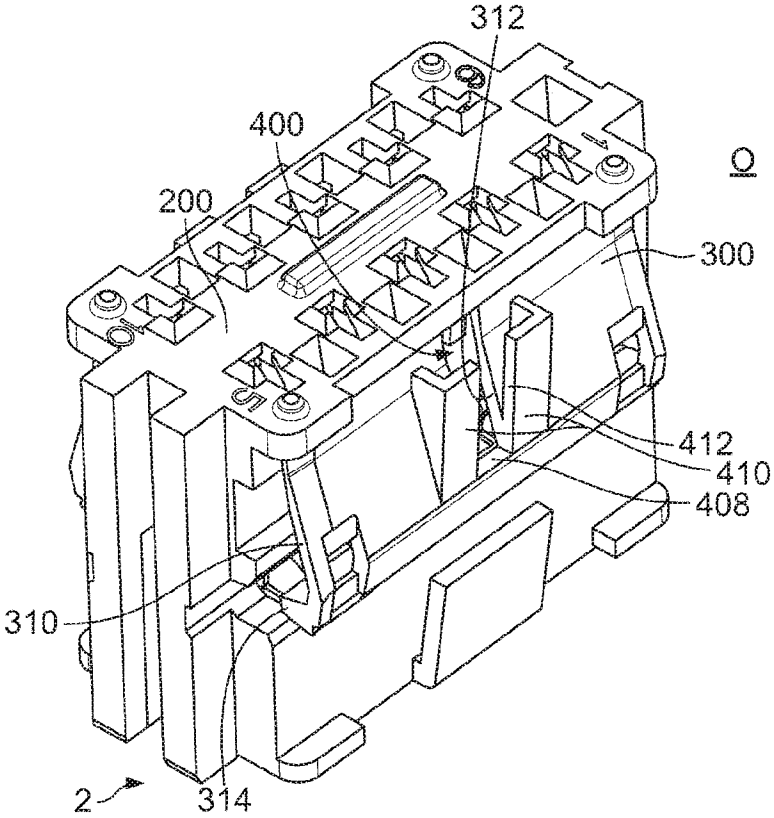
FIG. 13 is a perspective view of the contact housing with the contact securing flap in the open position with an unlocking compartment according to an embodiment.
Figure 16:
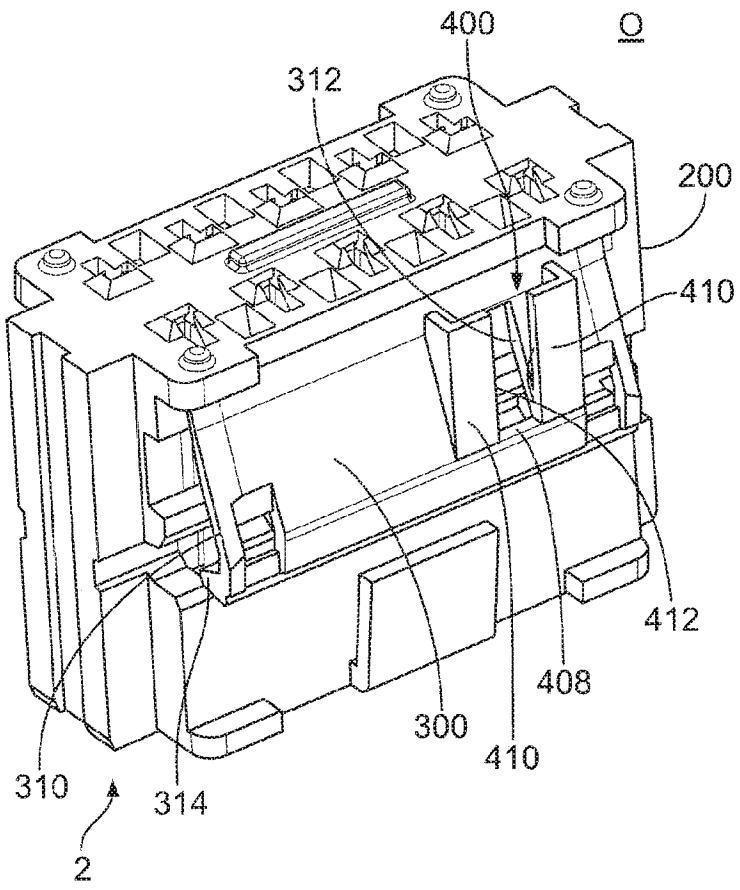
FIG. 16 is a perspective view of the contact housing with the contact securing flap in the open position with an unlocking compartment according to another embodiment.
Figure 15:
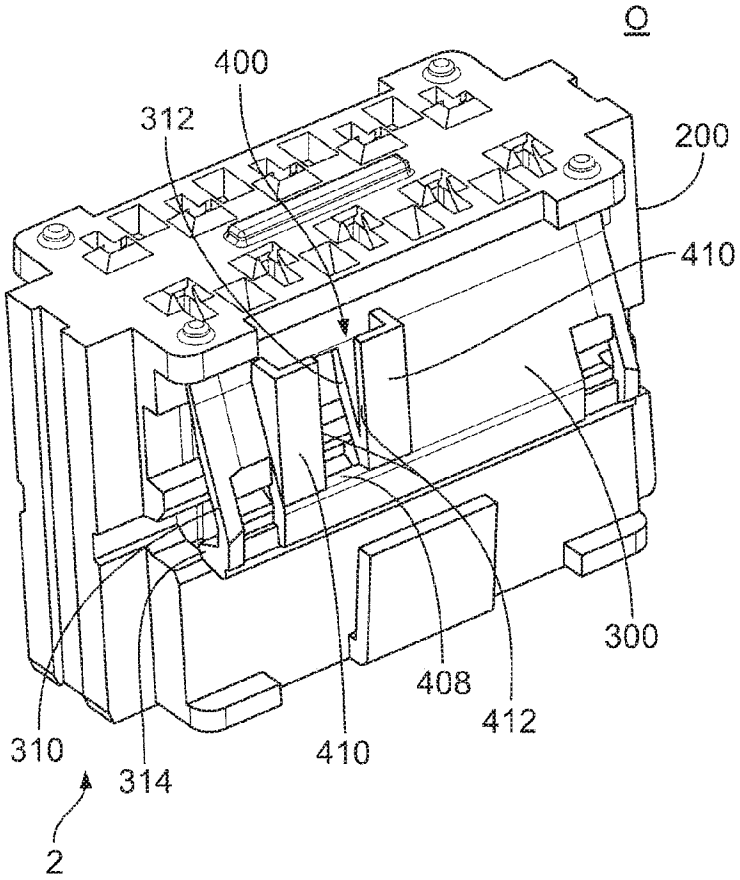
FIG. 15 is a perspective view of the contact housing with the contact securing flap in the open position with an unlocking compartment according to another embodiment.

If the contact securing flap 300 is located correctly in the locking position V, the testing tool 8 rests against the mechanical stop 607 of the contact housing receptacle 6 or the wall 630 thereof, as shown in FIGS. 5, 6 and 8. If the contact securing flap 300 is not located in its correct locking position V (incorrect locking position), the testing tool 8 rests against the mechanical stop 408 in the contact securing flap 300 or the flap wall 310 thereof, or at the unlocking compartment 400, as shown in FIGS. 7 and 9.

The unlocking tool 9 can be introduced (advanced and optionally pivoted) through the slot 500 into the unlocking compartment 400 for unlocking the contact securing flap 300 into the open position O, it being possible to bring the contact securing flap 300 out of engagement with the contact units 10.

When the contact securing flap 300 is brought from its open position O into its locking position V, the contact securing flap 300 projects into the slot 500 such that the contact securing flap 300 is displaceable by the locking tool 7. Furthermore, when the contact securing flap 300 is brought from its locking position V into its open position O, the contact securing flap 300 projects into the slot 500 such that the contact securing flap 300 is displaceable by the unlocking tool 9.

What is claimed is:

1. A connector housing for an electrical connector having a plurality of electrical contact units, comprising:

a contact housing receptacle; and a contact housing disposed in the contact housing receptacle, the contact housing having a movable contact securing flap, the contact securing flap is disposed inside the contact housing receptacle and is movable between an open position, in which the electrical contact units are unlocked in the connector housing, and a locking position in which the contact units are locked in the connector housing, the contact securing flap has an unlocking compartment, the contact securing flap can be moved from the locking position into the open position by the unlocking compartment, the contact securing flap can be moved from the open position to the locking position by a flap wall of the contact securing flap, the unlocking compartment is formed from the contact securing flap or protrudes from the contact securing flap, the unlocking compartment is formed by the flap wall and a compartment wall of the unlocking component spaced apart from the flap wall.

2. The connector housing of claim 1, wherein the contact housing is inserted in the contact housing receptacle in an open position of the contact securing flap, removal of the contact housing from the contact housing receptacle can take place with the contact securing flap in the locking position and/or in the open position.

3. The connector housing of claim 1, wherein testing of a correct locking position or an incorrect locking position of the contact securing flap relative to the electrical contact units occurs in the contact housing receptacle.

4. The connector housing of claim 1, wherein the locking position and/or the open position of the contact securing flap can be tested by a tool.

5. The connector housing of claim 4, wherein a locking tool can be moved along the flap wall and pivot the contact securing flap from the open position into the locking position.

6. The connector housing of claim 5, wherein the compartment wall and the flap wall have a testing recess into which a testing tool is inserted to test the locking position.

7. The connector housing of claim 6, wherein an unlocking tool is movable into the unlocking compartment to pivot or press the contact securing flap from the locking position to the open position.

8. The connector housing of claim 4, wherein the tool is moved through a slot between the contact housing receptacle and the contact housing.

9. The connector housing of claim 1, wherein a plane of the flap wall is oblique to a longitudinal direction of the connector housing in the open position, and a plane of the compartment wall is substantially parallel to the longitudinal direction in the open position.

10. The connector housing of claim 9, wherein the plane of the flap wall is substantially parallel to the longitudinal direction in the locking position, and the plane of the compartment wall is oblique to the longitudinal direction in the locking position.

11. A method of locking a plurality of electrical contact units in a connector housing to form an electrical connector, comprising:

fitting the connector housing with the contact units; and moving a locking tool separate from the connector housing into the connector housing from a side of a plug face of the connector, the locking tool actuating a contact securing flap of the connector housing to engage and lock the contact units, the contact securing flap has an unlocking compartment formed from the contact securing flap or protruding from the contact securing flap, the unlocking compartment is formed by a flap wall of the contact securing flap and a compartment wall of the unlocking component spaced apart from the flap wall.

12. The method of claim 11, wherein the locking tool is moved into the connector housing along an outside of the contact securing flap up to a mechanical stop, the locking tool changes an orientation of a flap wall of the contact securing flap.

13. The method of claim 12, wherein, after locking the contact units, a locking position of the contact securing flap can be tested by a testing tool moved into the connector housing, the testing tool is movable into the connector housing through an unlocking compartment of the contact securing flap and up to a mechanical stop of the contact housing receptacle in a correct locking position, the testing tool rests against a mechanical stop of the contact securing flap or the unlocking compartment in an incorrect locking position.

14. The method of claim 11, wherein the locking tool abuts a flap wall of the contact securing flap to pivots the contact securing flap from an open position in which the contact units are not locked to a locking position in which the contact securing flap locks the contact units.

15. The method of claim 14, wherein a plane of the flap wall is oblique to a longitudinal direction of the connector housing in the open position, and the plane of the flap wall is substantially parallel to the longitudinal direction in the locking position.

16. An electrical connector, comprising:

a plurality of electrical contact units; and a connector housing including a contact housing receptacle and a contact housing disposed in the contact housing receptacle, the contact housing having a movable contact securing flap, the contact securing flap is disposed inside the contact housing receptacle and is movable between an open position, in which the electrical contact units are unlocked in the connector housing, and a locking position in which the contact units are locked in the connector housing, the contact securing flap has an unlocking compartment formed from the contact securing flap or protruding from the contact securing flap, the unlocking compartment is formed by a flap wall of the contact securing flap and a compartment wall of the unlocking component spaced apart from the flap wall.

17. A method of unlocking and/or removing an electrical contact unit from an electrical connector, comprising:

moving an unlocking tool into a connector housing of the connector from a side of a plug face of the connector; and pivoting the unlocking tool to actuate an unlocking compartment of a contact securing flap of the connector housing and move the contact securing flap out of engagement with the contact unit, the unlocking compartment is formed from the contact securing flap or protrudes from the contact securing flap, the unlocking compartment is formed by a flap wall of the contact securing flap and a compartment wall of the unlocking component spaced apart from the flap wall.

18. The method of claim 17, wherein the compartment wall of the unlocking compartment is moved into an orientation of the flap wall of the contact securing flap by pivoting the unlocking tool, the contact securing flap can be pivoted an angular amount about which the compartment wall is moved to an open position.

19. The method of claim 18, further comprising withdrawing the contact unit including an electrical wire from the connector housing.

20. A method of locking a plurality of electrical contact units in a connector housing to form an electrical connector, comprising:

fitting the connector housing with the contact units;

moving a locking tool separate from the connector housing into the connector housing from a side of a plug face of the connector, the locking tool actuating a contact securing flap of the connector housing to engage and lock the contact units, the locking tool is moved into the connector housing along an outside of the contact securing flap up to a mechanical stop, the locking tool changes an orientation of a flap wall of the contact securing flap; and after locking the contact units, a locking position of the contact securing flap can be tested by a testing tool moved into the connector housing, the testing tool is movable into the connector housing through an unlocking compartment of the contact securing flap and up to a mechanical stop of the contact housing receptacle in a correct locking position, the testing tool rests against a mechanical stop of the contact securing flap or the unlocking compartment in an incorrect locking position.

* * * * *